US010689175B1

(12) United States Patent
Mundt

(10) Patent No.: US 10,689,175 B1
(45) Date of Patent: Jun. 23, 2020

(54) DYNAMIC PACKAGING

(71) Applicant: Apple Inc., Cupertino, CA (US)

(72) Inventor: Matthew Mundt, San Jose, CA (US)

(73) Assignee: Apple Inc., Cupertino, CA (US)

( * ) Notice: Subject to any disclaimer, the term of this patent is extended or adjusted under 35 U.S.C. 154(b) by 20 days.

(21) Appl. No.: 15/666,201

(22) Filed: Aug. 1, 2017

(51) Int. Cl.
*B65D 75/58* (2006.01)
*B65D 75/56* (2006.01)
*B65D 75/04* (2006.01)

(52) U.S. Cl.
CPC ..... *B65D 75/58* (2013.01); *B65D 75/04* (2013.01); *B65D 75/566* (2013.01)

(58) Field of Classification Search
CPC ..... B65D 5/72; B65D 5/724; B65D 75/58; B65D 75/04; B65D 75/566; B65D 73/00; B65D 5/5213; B65D 5/38; B65D 85/62; B65D 5/16
USPC ..... 206/467, 468, 495, 806, 738, 769, 462, 206/470, 736, 751, 756, 759, 461, 463, 206/471, 776, 739, 730, 747, 749, 758, 206/761, 765, 555, 556, 449, 817; 221/52, 56, 198, 226, 227, 279, 557, 271, 221/248, 208, 224, 250
See application file for complete search history.

(56) References Cited

U.S. PATENT DOCUMENTS 4,247,289 A * 1/1981 McCabe ..... B31D 5/04 206/521
4,632,242 A * 12/1986 Choi ..... B65D 11/10 16/429
5,975,349 A * 11/1999 Menes ..... B65H 1/06 221/232
6,378,702 B1 * 4/2002 Kintzig ..... G01N 33/4875 206/456
6,382,460 B1 * 5/2002 Gonzalez ..... A47K 10/427 221/232
6,863,192 B2 * 3/2005 Tumlinson ..... B65D 5/0005 221/45
7,523,841 B2 * 4/2009 Konig ..... B65D 83/0418 221/197
7,677,409 B2 * 3/2010 Reynolds ..... A61B 5/14532 221/232
7,721,881 B2 * 5/2010 He ..... B65D 85/1009 206/249
7,900,797 B1 * 3/2011 Witcraft ..... G07F 11/04 221/186
8,038,017 B2 * 10/2011 Close ..... A47F 1/126 211/59.3
8,646,621 B2 * 2/2014 Zacherle ..... A47F 1/126 206/526
9,738,433 B2 * 8/2017 Hogg ..... B65D 83/02
9,758,297 B2 * 9/2017 Chen
(Continued)

*Primary Examiner* — Rafael A Ortiz
(74) *Attorney, Agent, or Firm* — Sterne, Kessler, Goldstein & Fox P.L.L.C.

(57) ABSTRACT

A package may include a tray configured to receive a product. The product may be retained or positioned in the tray by a fixed anchor and one or more movable anchors. One or more paper springs may be coupled to the movable anchors, and bias the movable anchors in a retention configuration whereby the product is retained or positioned in a first configuration. Upon actuation of the movable anchors, and overcoming the spring force imparted by the paper spring, the product may be released from the packaging.

21 Claims, 9 Drawing Sheets

(56) References Cited

U.S. PATENT DOCUMENTS

| | | | | |
|---|---|---|---|---|
| 2005/0092644 | A1* | 5/2005 | Cafferata | A47F 1/126 206/471 |
| 2011/0253777 | A1* | 10/2011 | Ciecorka | B65D 5/328 229/122.27 |
| 2016/0090229 | A1* | 3/2016 | Stenberg | B65D 83/0894 221/1 |
| 2016/0374759 | A1* | 12/2016 | Bostley | E05B 65/006 206/438 |

* cited by examiner

DYNAMIC PACKAGING

FIELD

The described embodiments relate generally to retail packaging systems and methods. More particularly, the present embodiments relate to dynamic retail packaging for consumer products that may move to dynamically retain, release, or otherwise present the consumer product.

SUMMARY

Some embodiments include a product within retail packaging where the packaging includes a tray to receive the product. The product may be retained using paper-based mechanisms, for example, a fixed anchor and a movable anchor coacting to retain the product. The movable anchor may be biased in a retention configuration by a spring, e.g., a paper spring. In the retention configuration the anchors may engage the product through complementary-shaped surfaces (e.g., surfaces that follow the contour of the product), such that the product is held in place.

The paper spring may be hidden, such that it is invisible to a customer. The actuating mechanism to move the movable anchor may be communicated to the customer through one or more graphics, such that the customer may actuate the movable anchor, either directly or indirectly through an actuating mechanism, to release the product from the packaging. In some embodiments, the paper spring is attached to a surface of the tray, and biases the movable anchor such that the product is held in tension or compression. The paper spring may have a fixed end attached to a surface of the tray, and a dynamic end movable relative to the fixed end. The dynamic end of the paper spring may be attached to the movable anchor, which may be attached to a hang tab extending through an opening in the tray, such that the hang tab is the actuating mechanism to move the movable anchor. The hang tab is the only element a customer needs to interact with in order to release the product from the package in some embodiments.

In some embodiments, one or more components of the packaging are constructed entirely from paper, e.g., a sheet of paper substrate. For example, the tray may be integrally formed from a continuous substrate.

In some embodiments, the paper-based tray includes a movable anchor formed from folded paper, a paper spring coupled to the movable anchor, and a fixed anchor formed from folded paper and fixed to the tray, the movable anchor and fixed anchor together positioning the product within the packaging. In response to a force applied to the movable anchor in a direction away from the product and against a biasing force of the paper spring, the product is released to be removable from the packaging. One or more of the anchors may be disposed on a bottom surface of the tray.

In some embodiments, a hang tab is attached to an end of the movable anchor or paper spring opposite the movable anchor and through an opening in the tray. In some embodiments, the hang tab may be unitary, with the movable anchor or paper spring. In response to a force pushing the hang tab towards the tray the movable anchor moves against a force of the paper spring, such that the product is released. The opening may be disposed in a sidewall of the tray extending perpendicularly from the bottom surface.

The movable anchor may be a folded paper component. In some embodiments, the movable anchor is hollow, and the paper spring is disposed therein. In this way, the paper spring may be hidden from the customer opening the packaging.

In some embodiments, the fixed anchor and movable anchor together provide one or more of a tensile, compressive, or torsional force on the product. This may be a retention force on the product, retaining it in a particular position within the packaging. One or more of the anchors may include a surface shaped to engage a complementary-shaped surface of the product in a retention configuration. In some embodiments, the fixed and movable anchors are spaced equidistantly from terminal ends of the tray in a retention configuration.

One or more of the tray, anchors, or paper spring is constructed entirely from paper, in some embodiments, and is completely recyclable. In some embodiments, each of the tray, anchors, and paper spring is constructed entirely from paper. The movable anchor may be integrally formed from a continuous substrate. In some embodiments, the paper spring is integrally formed from a continuous substrate, for example, folded in a v-shape, or repeating v-shape in an accordion or zig-zag fashion.

The packaging or product may include a graphic indication on an exterior surface of the packaging to indicate how the movable anchor may be actuated to release the product from the packaging.

The tray may be formed entirely from paper, and include a bottom surface and sidewalls coupled to edges of the bottom surface. In this configuration, the sidewalls and bottom surface define a rectangular cuboid cavity. The fixed anchor and movable anchor may be configured to engage a product when the packaging is closed, and configured to release the product when the packaging is opened. The paper spring may be configured to bias the movable anchor such that the product is retained by the force produced by the spring between the fixed anchor and movable anchor acting together. As above, the paper spring is hidden from view when the tray is assembled, and the actuating mechanism may be actuated by a component on the exterior of the tray or packaging.

In some embodiments, the tray includes a bottom surface for receiving a product. The tray may include first and second sidewalls corresponding to the top and bottom of the packaging when the packaging is hung from a hang tab disposed on or proximate the first sidewall. The tray may include third and fourth sidewalls, for example, perpendicular to the first and second sidewalls. The tray may be substantially rigid (e.g., resistant to bending or twisting, such that when the paper mechanism is actuated the tray does not deform.)

The tray or other components of the packaging may be formed from a single sheet of material (e.g., a blank). In some embodiments, the blank is folded such that the tabs, flaps, and regions without adhesive are folded such that no adhesive is visible in a finished configuration. Additionally or alternatively, adhesive may be omitted from some or all of the regions, and the various flaps and tabs attached in another suitable manner (e.g., by mechanical interlocks between tabs and slots). An interior edge of the blank may fold inward, such that when folded over there is no raw edge on the outside of the packaging. Additional panels may be folded onto each other to eliminate raw edges on various surfaces of the packaging. Individual blank sections may be folded onto one another, for example to create the features of the packaging, including the movable anchor and paper spring.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
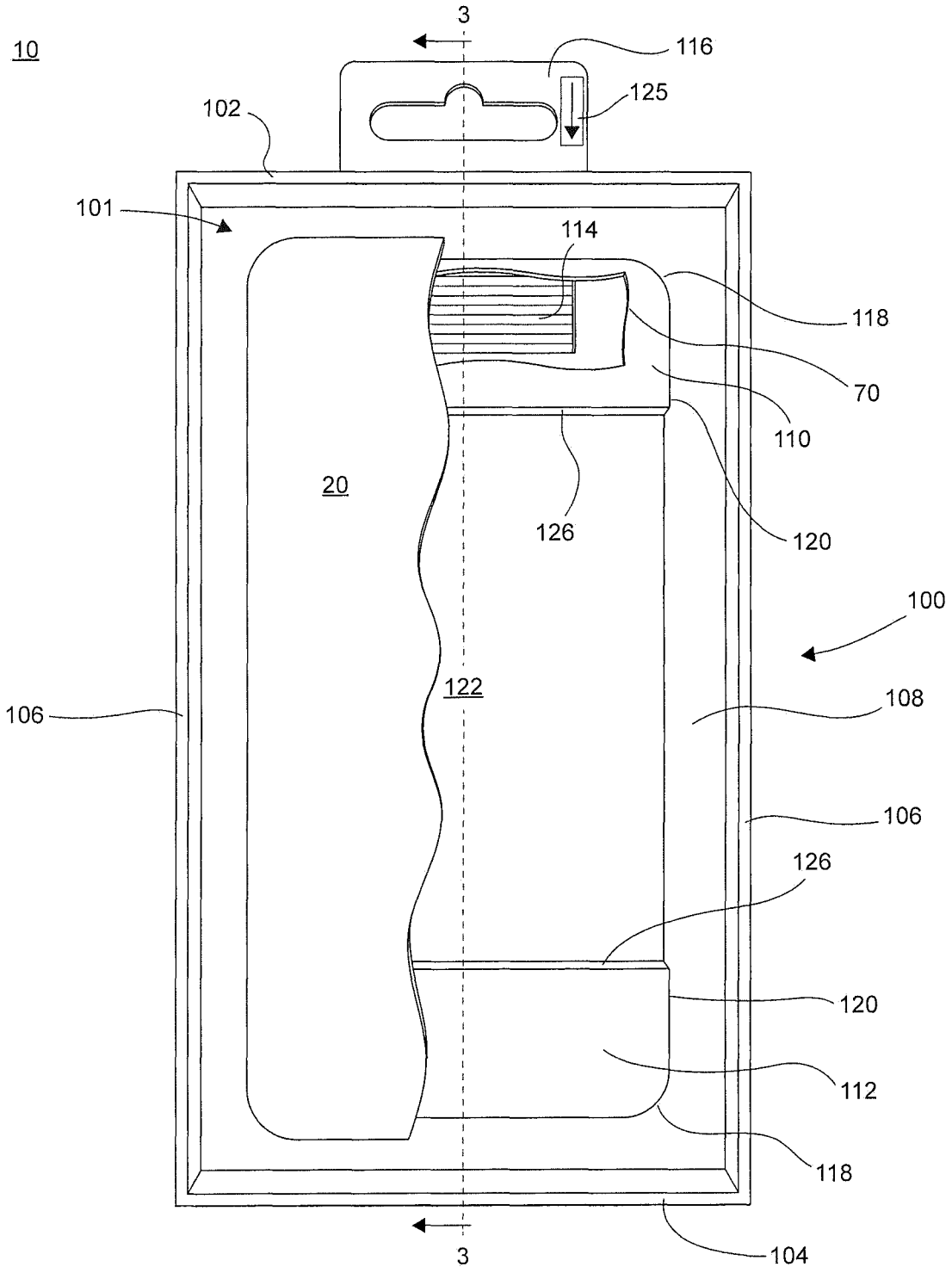
FIG. 1 shows a top perspective view of packaging in a first configuration.

Product packaging is an integral part of a customer's experience. It introduces the customer to their product, and can affect the customer's feelings toward the product and the company that created it. Dynamic packaging—packaging that engages a user through deliberate movement or mechanisms similarly may engage a customer. Additionally, dynamic packaging may be used, for example, to adjust for material or component tolerances to position, retain, or lock products into place within the packaging, and can be used as cushioning elements to protect against damage during shipping or when in a retail environment.

Packaging that achieves this dynamic, aesthetically pleasing packaging made from eco-friendly materials—is particularly desirable.

Packaging described in this document achieves this by starting with paper based materials. The product is supported or retained in position within the packaging by a paper-based mechanism. A paper spring is included in the mechanism, which results in a supporting or retaining force being applied to the product. The customer, through intuition or graphical instructions, interacts with the packaging to release the paper-based mechanism including the paper spring. The product then can be simply removed from the packaging, without damaging or destroying the packaging (which may result from packaging including tape or adhesive closures or tear strips/pull tabs). This is advantageous, because customers may want to inspect products in-store prior to purchase. With some packaging, if a customer opens it, the packaging may become damaged, such that that particular unit cannot be reshelved. The store may incur higher costs, due to obtaining new packaging or products (e.g., factory-sealed packaging).

The non-destructive nature of the packaging disclosed herein allows a customer to release the product within a store and interact with the product prior to purchase without requiring the customer to go through the trouble of moving ties, flaps, or other retention mechanisms. Further, this packaging may be repeatedly opened in-store—multiple potential customers may remove and replace the product when evaluating a purchase in-store, without affecting the packaging. Further, in situations where a product is directly sent to a customer, this results in an enhanced unboxing experience, since the product can be easily removed, and—if desired—the customer can keep the packaging to store the product. If and when the customer opts to dispose of the packaging, because the entire packaging (including the spring and movement mechanisms) is paper-based, the packaging may simply be recycled without requiring material separation (e.g., in a single-stream recycling program). The entirety of the packaging may be made from paper—the only non-paper element in the packaging may be the product.

Packaging for consumer products may be an important marketing tool used to attract and retain customers. Packaging should be aesthetically appealing, but at the same time direct a customer's attention to the product it is designed to hold. Packaging having defects or imperfections can draw the customer's attention away from the product it is holding or make the product seem less appealing. Optimization of packaging may promote a positive user experience. Packaging made out of recyclable and/or biodegradable materials, such as paper or paper-based products can reduce environmental impact. Packaging that is interesting in character and well-executed may boost a product's or a brand's reputation, thereby attracting new customers and retaining previous customers.

The packaging described herein may be used to hold and ship items, such as, for example, consumer products. The packaging may be retail packaging (i.e., finished packaging for containing and conveying a product to a user such as may be used in a retail setting, not shipping packaging for containing a packaged product during shipment) that one may expect to find on the shelf in a retail store, and which one may open to directly access their product. The product may be, for example, an electronic device (e.g., a laptop, tablet computer, or smartphone) or it may be a non-electronic device (e.g., a case for an electronic device, or book). In some embodiments, the packaging may be configured to allow a customer to release the product within a store, to interact with the product prior to purchase.

These and other embodiments are discussed below with reference to the figures. However, those skilled in the art will readily appreciate that the detailed description given herein with respect to these figures is for explanatory purposes only and should not be construed as limiting.

Figure 2:
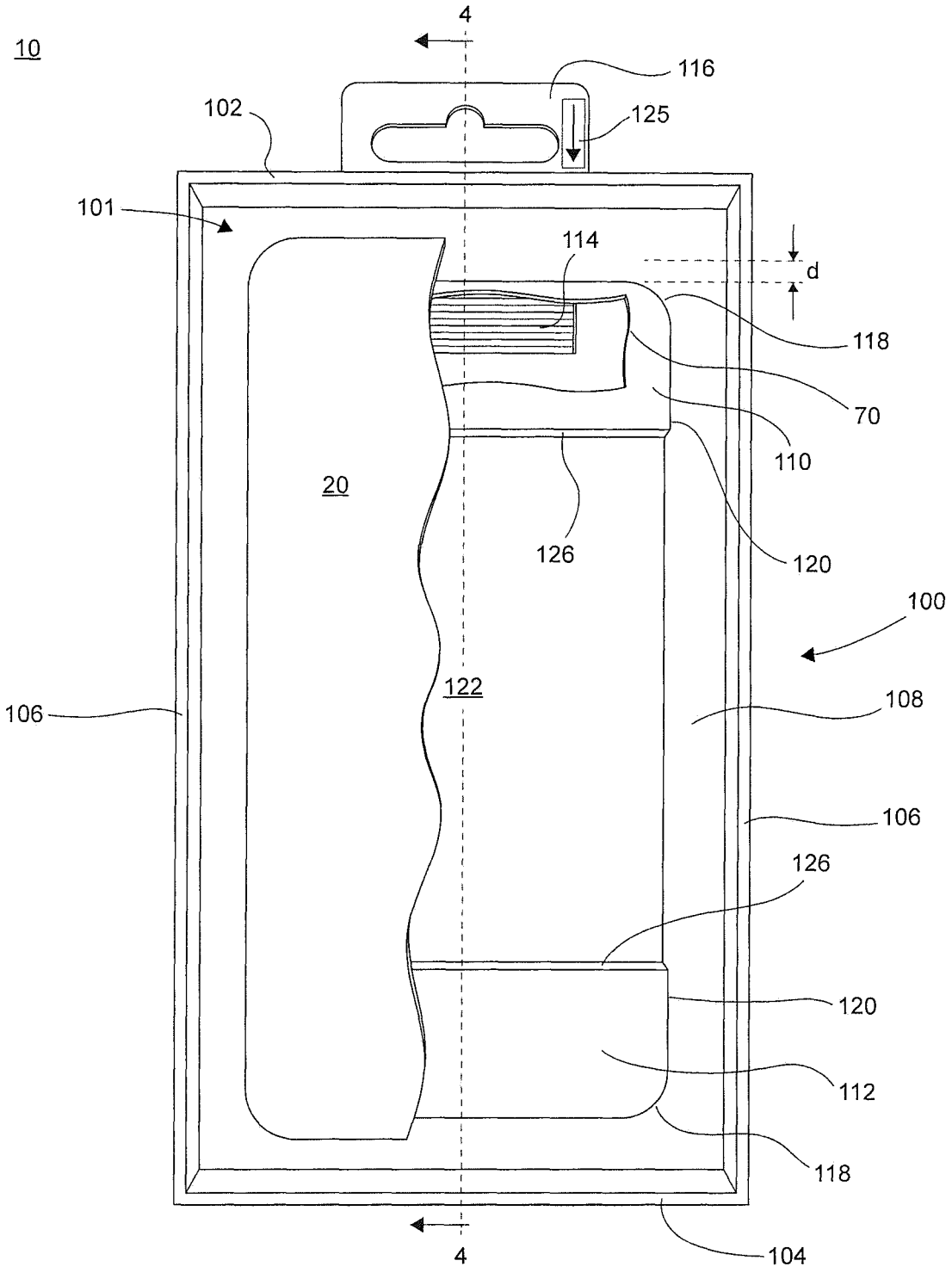
FIG. 2 shows a top perspective view of packaging shown in FIG. 1 in a second configuration.

Packaging 10 is shown in FIGS. 1-4. FIGS. 1 and 2 are top and bottom perspective views of packaging 10. As shown, packaging 10 includes a tray 100, supporting or retaining a product 20. As shown, product 20 may be a case, e.g., for an electronic device such as a mobile phone. As depicted, product 20 is shown broken away, to view components underneath it during use. In some embodiments, packaging 10 includes a lid, which contains product 20 between tray 100 and the lid when packaging 10 is closed. Tray 100 includes a first wall 102 and a second wall 104, disposed across from one another and extending substantially vertically from a bottom surface 108 of tray 100. In some embodiments, sidewalls 106 are included and extend from both first wall 102 and second wall 104, forming a generally rectangular cuboid-shaped cavity 101. Other shapes of tray 100, the lid, and packaging 10 in general are contemplated.

As shown, tray 100 may include a movable anchor 110 and a fixed anchor 112, such that a distance between the anchors is adjustable. In some embodiments, anchors may be separate components, as shown in the figures. In other embodiments, one or more of the anchors may be other features of tray 100, such as the bottom surface or sidewalls.

Tray 100 has a first configuration shown in FIG. 1, and second configuration shown in FIG. 2, showing movable anchor 110 and fixed anchor 112 and their relative positions. The relative positions may be achieved through actuation of a mechanism, including a paper spring 114 (shown within broken region 70). Broken region 70 is shown to illustrate paper spring 114 within movable anchor 110, and may not actually be an open surface on movable anchor 110. In some embodiments, broken region 70 may be configured as a window or opening, such that paper spring 114 is visible inside movable anchor 110. As shown, paper spring 114 is connected to a bottom surface 108 of tray 100, and may engage movable anchor 110 on one end. Movable anchor 110 or paper spring 114 is connected to a hang tab 116 on a dynamic end opposite from the static end of paper spring 114 to bottom surface 108, such that motion of movable anchor 110 and paper spring 114 can be influenced by motion of movable anchor 110 or hang tab 116.

In general terms, paper spring 114 and movable anchor 110 are movable between a first position and a second position. The second position may be further from the paper spring's 114 neutral position than the first position such that the spring force is greater in the second position. In some embodiments, paper spring 114 and movable anchor 110 move automatically from the second position to the first position upon removal of a force maintaining paper spring 114 and movable anchor 110 in the first position. In some embodiments, packaging 10 retains product 20 within packaging 20 when in the first position, and releases product 20 when in the second position. In some embodiments, motion from the second position to the first position may be actuated by removal of a component of packaging 10 that is blocking such movement (see, e.g., actuator 50 in FIGS. 10 and 11).

In some embodiments, paper spring 114 may be connected solely to a bottom surface 108 of tray 100, such that a dynamic end of paper spring 114 is freely floating, and engages movable anchor 110 without directly connecting to it. In this regard, assembly of finished packaging 10 is simplified, such that only one end of paper spring 114 need be directly affixed to a surface of packaging 10, such as through adhesive, tape, or other securing means. The compressive spring force of the spring pressing against movable anchor 110 and its secured end at packaging 10 creates the movement required to engage product 20. In some embodiments, a portion of movable anchor 110 may be fixed, such that no end of paper spring 114 need be directly attached. In some embodiments, paper spring 114 may be coupled to and engage multiple movable anchors. In some embodiments, paper spring 114 may engage no fixed anchors, and may be attached to no fixed surface.

Paper spring 114 may be hidden from view, e.g., where top surface of movable anchor 110 may be closed, hiding paper spring 114. Paper spring 114 may be formed as a separate component, or may be integrated with, for example, movable anchor 110. In some embodiments, paper spring may be formed integrally with tray 100, e.g., from a portion of the bottom surface 108.

Figure 3:
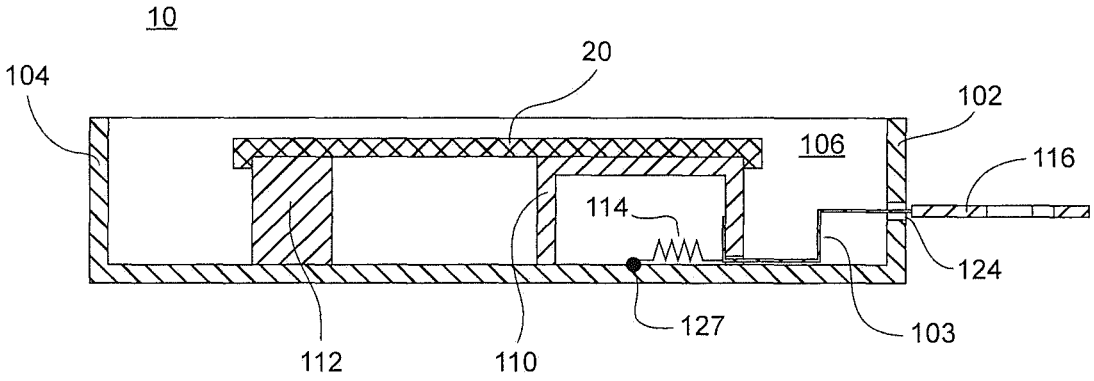
FIG. 3 shows a cut-away view schematic illustration of the packaging taken along line 3 in FIG. 1.
Figure 4:
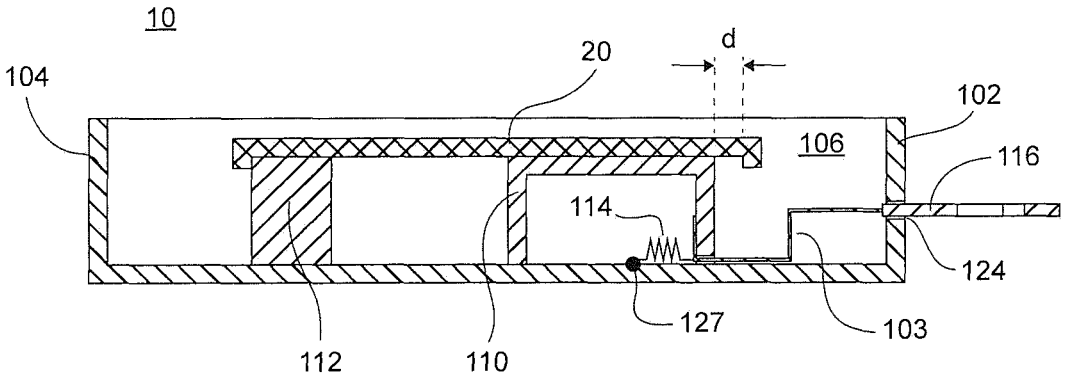
FIG. 4 shows a cut-away view schematic illustration of the packaging taken along line 4 in FIG. 2.

As shown, a portion of paper spring 114 may engage movable anchor 110 such that it is movable to disengage a surface of a product (as shown in schematic cross-sectional views of FIGS. 3 and 4). Advantageously, this improves upon prior systems having solely static, fixed anchors, where excess product, assembly, or packaging tolerance issues result in either products being too difficult to remove from the packaging, or not be securely retained within the packaging. This is because paper spring 114 may be configured to have a range of motion through which it will have a sufficient force to retain product 20, and that range of motion is sized to be much greater than typical retention tolerances in a fixed packaging. Dimensional tolerances on product 20, combined with dimensional tolerances on packaging 10, are absorbed and accommodated through the range of motion of paper spring 114.

In some embodiments, paper spring 114 may act as a shock absorber, absorbing movement such as that due to shock loading in shipment, or the like. Paper spring 114 may augment, or replace, certain shock absorbing materials, such as knit spacers, foams, etc., due to the dynamic tolerance the paper spring provides packaging 10. Paper spring 114 may thereby prevent damage to product 20 during shipment, for example, or if a customer drops packaging 10 in-store, prior to purchase.

Figure 6:
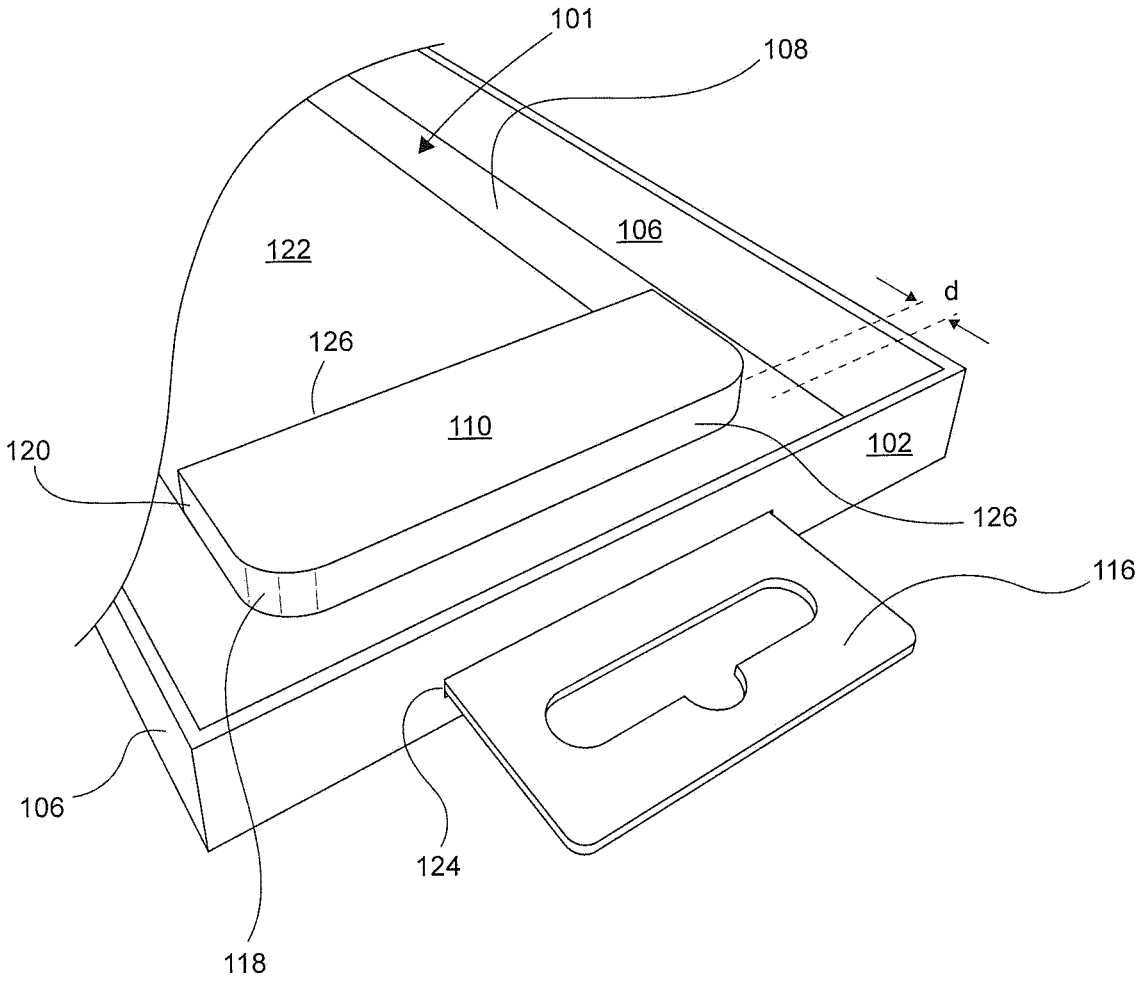
FIG. 6 shows an enlarged perspective view of the packaging shown in FIG. 2.

Comparing FIGS. 1 and 2, hang tab 116 and movable anchor 110 (or paper spring 114), coupled together, are actuated and displace movable anchor 110 towards fixed anchor 112 by a distance "d" (as shown in FIGS. 2 and 6). This allows product 20 to disengage and be released from packaging 10, and allows a customer to remove product 20 from the packaging 10. An exemplary cross-sectional schematic illustration of this process is shown in FIGS. 3 and 4, showing how product 20 may be held.

In some embodiments, product 20 may be a case, e.g. a mobile phone case or other electronic device case. In these embodiments, anchors 110 and 112 engage opposing inner walls or edges of the case. As the distance between anchors 110 and 112 decreases through the actuation of the mechanism, the movable anchor 110 will disengage the inner wall or edges on that side, and release product 20. In other embodiments, product 20 may be held between anchors 110 and 112, where in order to release product 20, the distance between anchors 110 and 112 are increased through actuation of the mechanism. Rounded surface 118 may be shaped to engage the interior contour of a mobile phone case, for example, such that movable anchor 110 coacts with fixed anchor 110 to provide tensile force on an interior contour of the case in a product retention configuration. In some embodiments, the contour may be reversed, e.g., when spring 114 is configured to provide compression between anchors 110 and 112, such as end caps for a mobile phone.

In some embodiments, packaging 10 may include a graphic 125 that indicates that the hang tab 116 should be moved in a particular direction. For example, graphic 125 could be placed on first wall 102, proximate opening 124, indicating that hang tab 116 should be moved in a particular direction (e.g., pressed towards opening 124). In some embodiments, graphic 125 could be placed directly on hang tab 116, or sidewall 106. In some embodiments, multiple graphics may be included, and may be different depending on their location about packaging 10. The graphic may include an arrow, or schematic illustration of the paper mechanism releasing product 20, in order to communicate to the customer the existence of the paper mechanism. As above, in some embodiments, paper spring 114 is hidden such that the customer cannot tell that the actuating mechanism is a paper spring.

Paper spring 114 may be configured as a compression spring, as shown in the figure, and may simply be a paper-based element that is folded onto itself repeatedly in an "accordion" or "zig-zag" fashion. In other embodiments, paper spring 114 may be an extension spring, torsion spring, constant force spring, Belleville spring, spring clip, natural spring, leaf spring or other type of spring. In some embodiments, paper spring 114 may be made from a higher grammage paper than other components (e. g., elements of tray 100 such as the sidewalls, anchors 110 and 112, or a lid and sleeve), of the packaging 10.

Turning to FIGS. 3-4, schematic cross-sections are shown of packaging 10, showing the releasing of product 20 based on the movement of the paper-based mechanism in a first configuration retaining product 20 (FIG. 3) and a second configuration releasing product 20 (FIG. 4). As shown, paper spring 114 may be a compression spring. Hang tab 116 may be connected to movable anchor 110 or paper spring 114 through an intermediate member 103. Within movable anchor 110, paper spring 114 may be secured to tray 100 (e.g., at lower surface 122, through adhesive 127). Due to the compressive nature of paper spring 114, movable anchor 110 may be biased towards hang tab 116, which connects to paper spring 114 at a dynamic end (through movable anchor 110), and passes through opening 124 of tray 100.

In the first configuration (FIG. 3) product 20 is subjected to a tensile force between fixed anchor 112 and movable anchor 110. This allows for more relaxed tolerances in dimensions of product 20 and packaging 10, because potential gaps or variations among the dimensions of different products 20 are accounted for in the tensile force applied to the product. In some embodiments, depending on the features and nature of product 20, compressive or torsional forces may be imparted by paper spring 114, depending on the construction of the mechanism. As shown in FIG. 4, product 20 may be released, due to the distance between anchors 110 and 112 decreasing, allowing product 20 to be removed from packaging 10.

Figure 5:
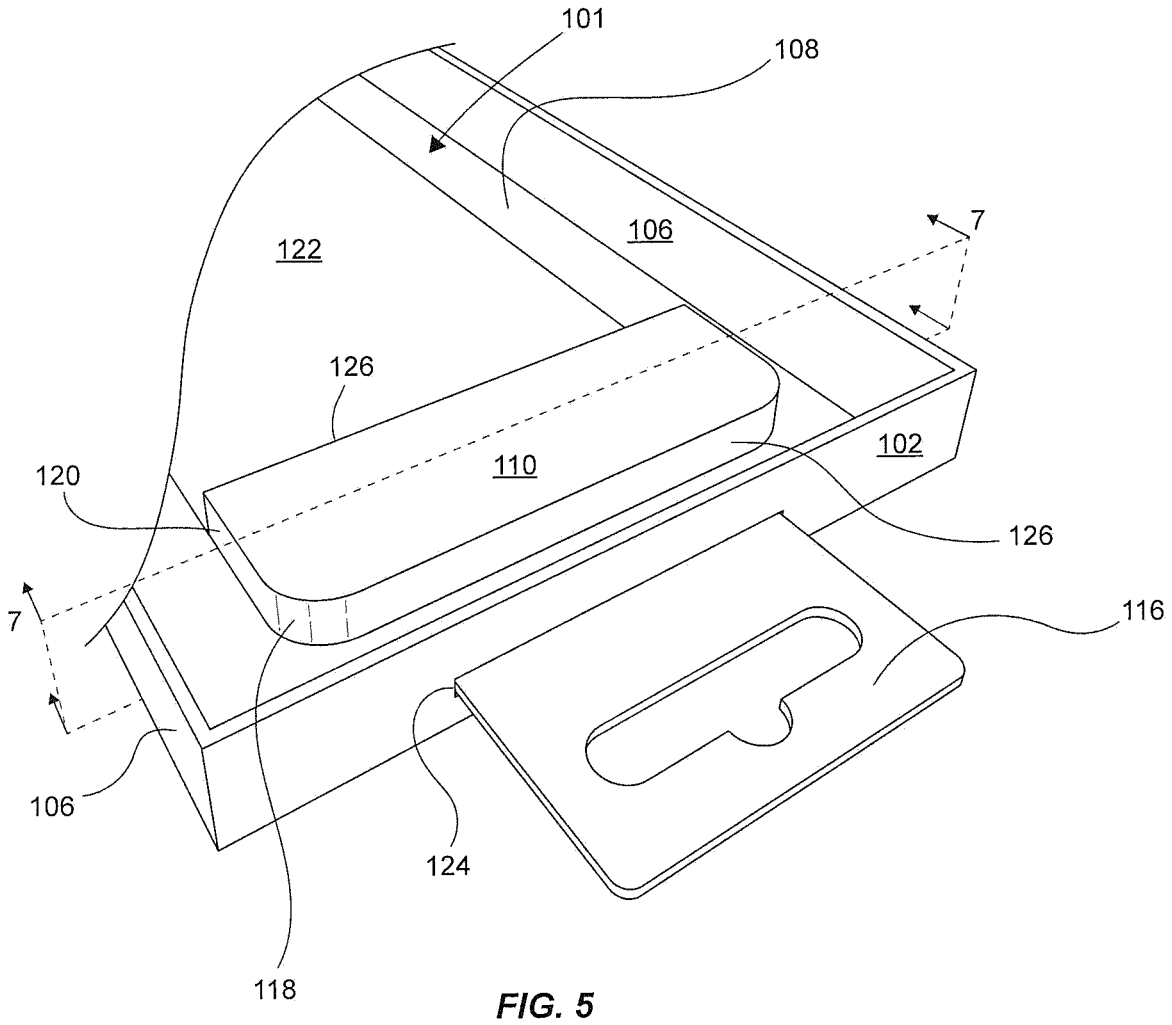
FIG. 5 shows an enlarged perspective view of the packaging shown in FIG. 1.

Turning to FIGS. 5 and 6, a portion of a perspective view of tray 100 is shown. As shown, first wall 102 includes opening 124 through which paper spring 114 or movable anchor 110 and hang tab 116 may be connected. In this way, the inner workings of the paper-based mechanism may be hidden from view from the customer. As shown, movable anchor 110 (and similarly fixed anchor 112) may include rounded surface 118, e.g., to engage a surface of product 20. Anchors 110 and 112 may each have opposing inner edges 126, e.g., which do not engage a surface of product 20 in any configuration.

Figure 7:
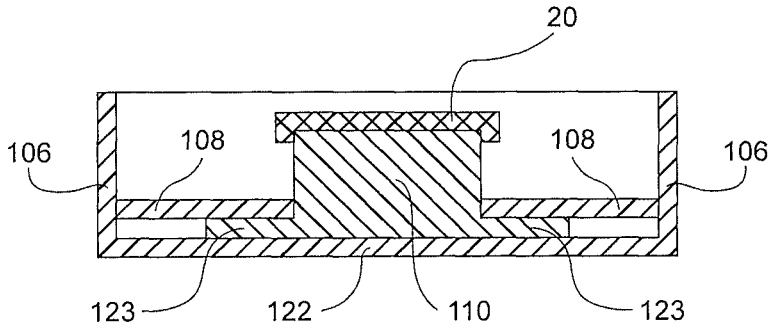
FIG. 7 shows a cut-away view schematic illustration of the packaging taken along plane 7 in FIG. 5.

A schematic cross-section is shown of packaging 10 in FIG. 7. In some embodiments, movable anchor 110 may be disposed such that a portion of its structure is between the layers of lower surface 122 and bottom surface 108 of the tray, such that there is a track formed between the two layers that is hidden from view during use. In this way, movable anchor 110 may be guided along the edges of lower surface 122 along a track element created by the layering of bottom surface 108 on top of lower surface 122. Movable anchor may include elements that are configured to slide along the track, such as wings 123. In this way, the inner working mechanism is hidden from the customer, and only through pushing hang tab 116 down along a longitudinal access of the tray 100 will the movable anchor 110 be visibly moved. This clean aesthetic contributes to the high-end feeling of this packaging, and keeps exposed movable components to a minimum. In some embodiments, anchors 110 or 112 may be configured to project into or through a detent, indentation, hole, or other feature of a product, such as a watch band adjustment hole, for example.

Figure 8:
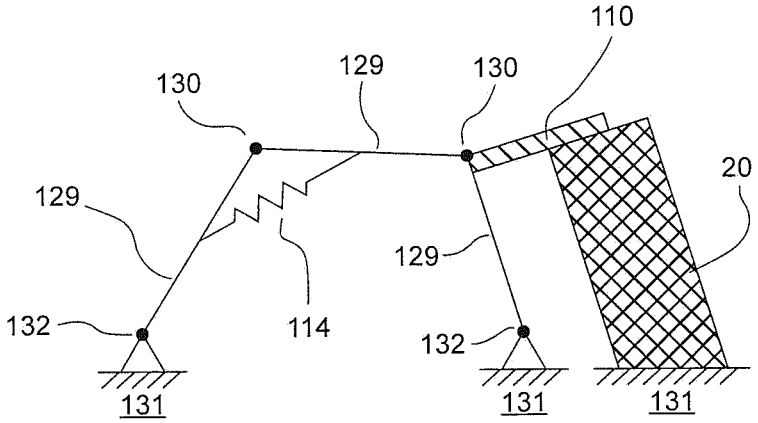
FIGS. 8 and 9 show schematic illustrations of packaging in various positions.
Figure 9:
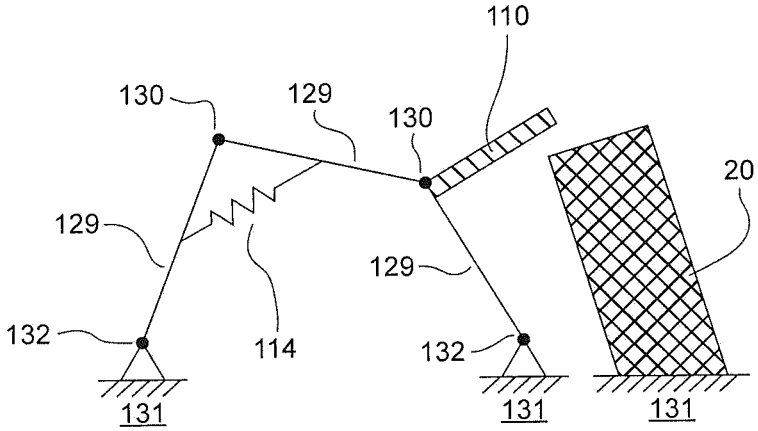

Turning to FIGS. 8 and 9, another embodiment of a paper-based mechanism is shown, including paper spring 114 with movable anchor 110. As shown, the paper based mechanism may be a linkage, e.g., a three- or four-bar linkage. One or more of the links 129 may be made from paper. The mechanism may include a paper hinge 130, or paper damper or paper isolator for example. The linkage may be directly actuated by a customer, for example by pressing on or pulling one of the links 129 or anchor 110.

As shown, in a first configuration (FIG. 8), the links of the linkage may be positioned such that movable anchor 110 engages product 20. In another configuration (FIG. 9), the linkage may be actuated—at one or more of the links or at anchor 110 itself—such that movable anchor 110 disengages the product 20. As shown in the figure, the product 20 may simply be held in position through the interaction with movable anchor 110 and a mechanically grounded surface 131, such as any surface of tray 100.

In other embodiments, the linkage may be indirectly actuated, e.g., through simply opening the package or interacting with an ancillary packaging structure, which may release the mechanism from a constrained position. As with other embodiments, depending on the features and nature of product 20, tensile, compressive, or torsional forces may be imparted by paper spring 114, depending on the construction of the mechanism. In this regard, additional movement and customer engagement is possible, such that a dynamic packaging is further emphasized. In some embodiments, paper spring 114 provides a constant force on product 20. In other embodiments, the force provided by paper spring 114 may vary, e.g., according to position of movable anchor 110.

Figure 10:
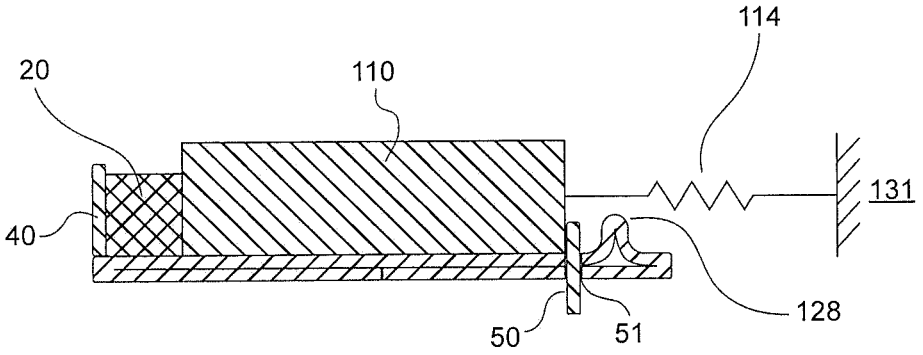
FIGS. 10 and 11 show schematic illustrations of packaging in various positions.
Figure 11:
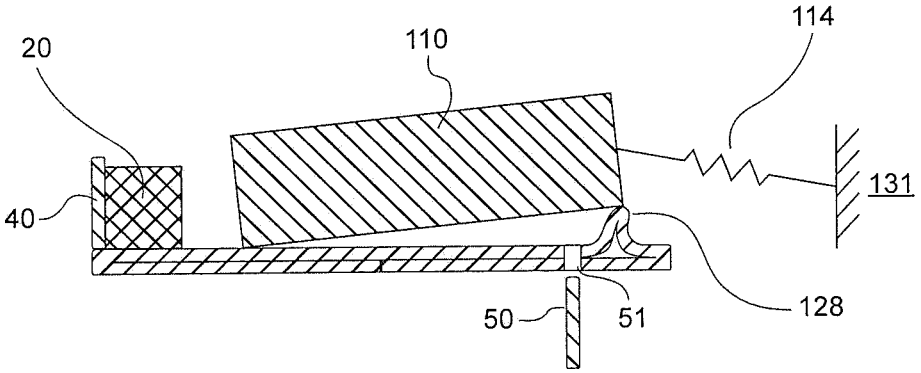

As shown in FIGS. 10 and 11, another embodiment of a paper-based mechanism is shown, including paper spring 114 with movable anchor 110. As shown, in one configuration (FIG. 10), movable anchor 110 may engage product 20, with support member 40 providing a stationary surface to hold product 20. In some embodiments, packaging 10 includes actuator 50, which is placed in a holding portion 51 (e.g., a hole in tray 100) in a first configuration, preventing spring 114 from pulling movable anchor 110.

In a second configuration (FIG. 11), paper spring 114 may move movable anchor 110 across a rib 128. This action may produce an audible or haptic feedback signal, such as a pop or click. In some embodiments, movable anchor 110 may release product 20 through action of paper spring 114, wherein the audible or haptic feedback signal serves as an indication to the customer that the product 20 is now released, free to be removed from packaging 10. As shown, rib 128 may deflect through interaction with movable anchor 110, producing the feedback indication.

In some embodiments, rib 128 may be actuated by a component other than movable anchor 110, such as an ancillary component of packaging 10, such as actuator 50 being removed from holding portion 51. In this way, a separate component may be configured to release the mechanism, and allow paper spring 114 to move movable anchor 110. For example, rib 128 may be actuated by a lid or sleeve of packaging 10, such as when a customer frees tray 100 from a lid or sleeve.

Figure 12:
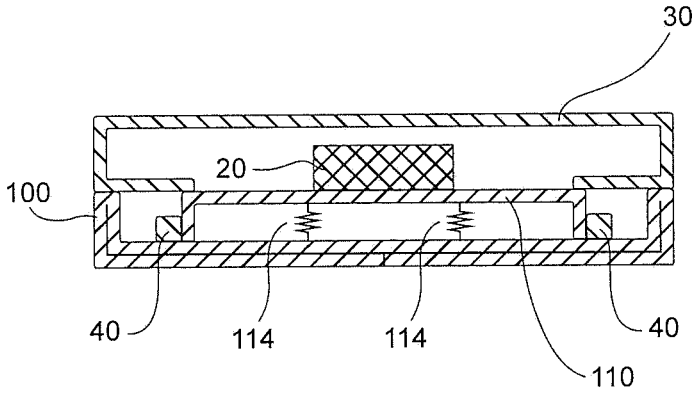
FIGS. 12 and 13 show schematic illustrations of packaging in various positions.
Figure 13:
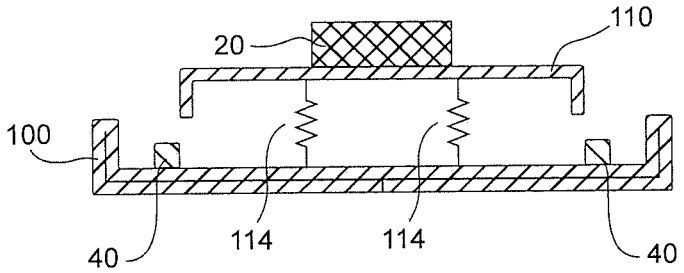

Turning to FIGS. 12 and 13, a raising platform embodiment is shown, whereby paper spring 114 lifts platform-based movable anchor 110. As shown, in some embodiments, multiple paper springs 114 may be used. In some embodiments, paper springs 114 may provide force in a single direction. In some embodiments, paper springs 114 may provide force in different or opposing directions. In some embodiments the magnitude of force applied through each spring is different (e.g., they have different spring constants). Support members 40 may locate movable anchor 110. In some embodiments, support members 40 may be configured as a collar, surrounding in whole or in part movable anchor 110. As shown, packaging 10 may include lid 30, disposed above tray 100. Lid 30 and tray 100 house product 20. In some embodiments, lid 30 may engage and retain movable anchor 110 in a first configuration (when the packaging 10 is closed, for example, as shown in FIG. 12).

As shown in the second configuration (FIG. 13), when lid 30 is removed, packaging 10 may adjust to a second configuration, whereby paper spring 114 raises movable anchor 110, and in turn raising product 20 above tray 100. In some embodiments, movable anchor 110 may interact with ribs as described above, for example, disposed on support members 40, to produce an audible or haptic feedback that indicates that the product is ready to be removed from packaging 10. In some embodiments, paper spring 114 may be configured to absorb movement, such as shock loading in shipment, or the like.

Packaging 10 has been referenced in some embodiments including a lid, however a lid may be omitted, or a different closure element included, such as a sleeve. In some embodiments, a customer may remove product 20 from tray 100 to inspect product 20 without damaging packaging 10. This is in contrast to packaging having adhesive, tape, etc., that inhibit their opening and that may result in changed or damaged packaging upon overcoming the inhibition and opening the packaging.

Components of packaging 10 may be formed from one or more blanks. In some embodiments, the blank is formed of a single continuous substrate, such as, for example paper or a paper-based material like cardboard or paperboard. In some embodiments, interior surfaces of the blank may be surface treated or coated, for example with a coating to protect the finished component such as tray 100, or product 20. Tabs, flaps, and regions without adhesive of the blank are folded such that no adhesive is visible in finished packaging 10. In some embodiments, adhesive may be omitted and the various flaps and tabs attached in another suitable manner. Fold lines may be formed, for example, by weakening the substrate along the lines, such as by perforation, material crushing, scoring, miter cutting, etc.

Packaging 10 is constructed to give a clean, unitary appearance. This helps to reinforce its high quality and robust character, and that of the product 20. To achieve this appearance, seams, gaps, and raw material edges are minimized (raw material edges are edges formed by cutting through a flat material, where the substance of the material between its outer flat surfaces is revealed). In some embodiments, components of the packaging may be folded from one or more sheets, such that when folded over and adhered together there is no raw edge on the outside of the component or packaging 10. As shown in the figures, panels may be folded onto each other to eliminate raw edges on various surfaces of tray 100 or other packaging 10 components. In some embodiments, components of packaging 10 may be constructed with multiple blanks.

In some embodiments, any surface finishing may take place after the components are cut from the blank, or alternatively prior to the blank being cut into separate sheets for assembling to a final product. Additionally, some operations may be performed concurrently.

The packaging components may be composed of a recyclable material (e.g., a biodegradable or compostable material). For example, each of the packaging components may be formed of paper-based materials (e.g., material formed of dried cellulose pulp), such as, for example, paperboard. Each of tray 100, anchors 110 and 112, and spring 114 may be formed from folded paperboard (e.g., greyboard cardboard or solid bleached sulfate (SBS)).

Alternatively, some or all of the components described as being formed of paper may instead be formed of a polymeric material. Suitable polymeric materials include, but are not limited to, polyethylene, polypropylene, polyurethane, polystyrene, polymer blends including one or more of these polymers, or co-polymers including one or more of these polymers. All or some of the surfaces of the packaging (including the paper spring) may be coated, or laminated, which may increase structural strength properties such as rigidity and which may protect a product within the packaging, or avoid scratching. The paper spring could also be replaced with a different type of spring, e.g., a silicone spring, or raw rubber spring, for example, or a metallic spring.

Additionally, the packaging may be manufactured in a cost-effective and environmentally-friendly way. In some embodiments, the packaging components may be constructed of a single integrally-formed piece of material. The single integrally-formed piece of material may be a foldable material that is folded into a configuration that holds and secures a product, either alone or within a cavity of a packaging container. In some embodiments, the foldable material may be a single piece of material that is cut by a single operation (e.g., a single die cutting operation). In some embodiments, the foldable material may be die cut from a stock material (e.g., a sheet or roll of material). Single integrally-formed pieces of material that are cut by a single cutting operation may facilitate efficient and reproducible manufacturing. Moreover, such manufacturing may reduce waste by reducing waste material during manufacturing.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings.

It will be apparent to one of ordinary skill in the art that many modifications and variations are possible in view of the above teachings, and that by applying knowledge within the skill of the art, one may readily modify and/or adapt for various applications such specific embodiments, without undue experimentation, without departing from the general concept of the present invention. Such adaptations and modifications are intended to be within the meaning and range of equivalents of the disclosed embodiments, based on the teaching and guidance presented herein.

The Detailed Description section is intended to be used to interpret the claims. The Summary and Abstract sections may set forth one or more but not all exemplary embodiments of the present invention as contemplated by the inventor(s), and thus, are not intended to limit the present invention and the claims.

The present invention has been described above with the aid of functional building anchors illustrating the implementation of specified functions and relationships thereof. The boundaries of these functional building anchors have been arbitrarily defined herein for the convenience of the description. Alternate boundaries can be defined so long as the specified functions and relationships thereof are appropriately performed.

The phraseology or terminology used herein is for the purpose of description and not limitation, such that the terminology or phraseology of the present specification is to be interpreted by the skilled artisan.

The breadth and scope of the present invention should not be limited by any of the above-described exemplary embodiments, but should be defined in accordance with the claims and their equivalents.

What is claimed is:

1. A product with packaging, comprising:

a product;

a tray, comprising:

a movable anchor comprising folded paper;

a paper spring coupled to the movable anchor; and a fixed anchor comprising folded paper and fixed to the tray, wherein the movable anchor and fixed anchor together retain the product in position relative to the packaging under force applied by the paper spring, and wherein in response to a force moving the movable anchor relative to the product and against a biasing force of the paper spring, the product is released and removable from the packaging.

2. The product with packaging of claim 1, wherein the product is replaceable after its removal, with no destruction of any part of the packaging.

3. Packaging, comprising:

a bottom surface;

a fixed anchor disposed on the bottom surface;

a movable anchor disposed on the bottom surface, the movable anchor movable linearly toward and away from the fixed anchor; and a paper spring attached to the bottom surface and coupled to the movable anchor and biasing the movable anchor toward or away from the fixed anchor;

wherein the packaging is configured to retain a product under a retention force applied to the product by the bias of the paper spring on the movable anchor, and wherein in response to a force overcoming the bias the movable anchor moves relative to the fixed anchor to release the product.

4. The packaging of claim 3, further comprising a movable hang tab coupled to the movable anchor and extending through an opening in the packaging, wherein a force moving the hang tab relative to the packaging also moves the movable anchor.

5. The packaging of claim 4, wherein the opening is disposed in a sidewall of the packaging extending perpendicularly from the bottom surface.

6. A product with packaging, comprising:

the packaging of claim 3; and the product retained by the movable anchor and the fixed anchor.

7. The product with packaging of claim 6, wherein the fixed anchor and movable anchor together provide a tensile retention force on the product.

8. The product with packaging of claim 6, wherein the fixed anchor and the movable anchor together provide a compressive retention force on the product.

9. The product with packaging of claim 6, wherein the fixed anchor and the movable anchor together provide a torsional force on the product.

10. The product with packaging of claim 6, wherein the movable anchor includes a surface shaped to engage a complementary-shaped surface of a product in a retention configuration.

11. The packaging of claim 3, wherein the movable anchor is hollow, and wherein the paper spring is disposed within the movable anchor.

12. The packaging of claim 3, wherein each of the packaging, anchors, and paper spring is constructed entirely from paper.

13. The packaging of claim 3, wherein the movable anchor is formed from a continuous substrate.

14. The packaging of claim 3, wherein the paper spring is formed from a continuous substrate.

15. The packaging of claim 14, wherein the continuous substrate is folded in a repeating v-shape.

16. The packaging of claim 3, wherein the product is replaceable into the packaging after its removal from the packaging, with no destruction of any part of the packaging.

17. The packaging of claim 3, further comprising a lower surface disposed below the bottom surface, the lower surface and bottom surface providing a track therebetween, wherein the movable anchor includes wings disposed within the track such that the movable anchor slides along the track when moved.

18. Packaging formed entirely from paper, the packaging comprising:

a movable anchor; and a paper spring coupled to the movable anchor, wherein the paper spring and the movable anchor are movable between a first position and a second position, the second position being further from the spring's neutral position than the first position, and wherein the paper spring and the movable anchor move automatically from the second position to the first position upon removal of a force maintaining the paper spring and the movable anchor in the first position.

19. The packaging of claim 18, wherein motion from the second position to the first position is actuated by removal of a component of the packaging that is blocking such movement.

20. The packaging of claim 18, wherein the packaging retains a product within the packaging when in the first position, and releases the product when in the second position.

21. The packaging of claim 18, wherein the movable anchor includes a surface shaped to engage a complementary-shaped surface of the product in the first position.

* * * * *